United States Patent [19]

Meckstroth

[11] 4,177,841

[45] Dec. 11, 1979

[54] HANGER FOR SUPPORTING PANTS AND THE LIKE AND METHOD OF PRODUCTION

[76] Inventor: Alan F. Meckstroth, 2357 Shelterwood Dr., Dayton, Ohio 45409

[21] Appl. No.: 950,370

[22] Filed: Oct. 11, 1978

Related U.S. Application Data

[63] Continuation of Ser. No. 829,231, Aug. 31, 1977, Pat. No. 4,120,433.

[51] Int. Cl.[2] ..... B21F 45/02

[52] U.S. Cl. ..... 140/81.5; D6/252

[58] Field of Search ..... 8/29, 231; 140/75, 80, 140/81, 81.5, 82, 83, 90, 91, 102; 150/12; 223/85, 95, 96, DIG. 1, DIG. 4; 24/73 C, 84 C; D6/247, 251, 252, 253

[56] References Cited

U.S. PATENT DOCUMENTS

| | | | |
|---|---|---|---|
| D. 76,341 | 9/1928 | Campbell | D6/252 |
| D. 205,567 | 8/1966 | Chambers | D6/252 |
| 2,191,714 | 2/1940 | Gustin | 223/85 |
| 2,926,824 | 3/1960 | St. Clair | 223/95 |
| 2,994,462 | 8/1961 | Hirsch et al. | 223/85 |
| 3,209,967 | 10/1965 | Hasselback | 223/96 |

FOREIGN PATENT DOCUMENTS

| | | | |
|---|---|---|---|
| 456296 | 5/1949 | Canada | 223/88 |
| 97063 | 11/1960 | Norway | 223/85 |

*Primary Examiner*—Lowell A. Larson

[57] ABSTRACT

A pants hanger is formed with parallel spaced first and second elongated support portions depending from a third support portion having a hook adapted to engage a horizontal clothes bar. The second support portion is cantileveredly positioned above the first support portion and is integrally connected by the first support portion to the third support portion. The free end of the second support portion extends past the integral connection of the first and third support portions to form a guide. In one embodiment, the support portions of the hanger are formed by bending a one-piece metal rod. The hanger is attached to a pair of pants by inverting both the pants and the hanger and then moving the hanger so that the second support portion slides onto one side of the pants, and the first and third support portions slide onto the other side of the pants. When the hanger is rotated to an upright position, the pants wrap around the second support portion and are retained in a depending position below the hook.

6 Claims, 6 Drawing Figures

HANGER FOR SUPPORTING PANTS AND THE LIKE AND METHOD OF PRODUCTION

RELATED APPLICATION

This application is a continuation of U.S. application Ser. No. 829,231, filed Aug. 31, 1977, now issued as U.S. Pat. No. 4,120,433 granted Oct. 17, 1978.

BACKGROUND OF THE INVENTION

There have been many types of hangers either constructed or proposed for supporting slacks or pants by the "cuff" ends of the legs so that the weight of the suspended pants aid in removing wrinkles from the pants. One type of hanger includes opposing clamping members which pinch the "cuff" ends of the pants together. Another type of hanger incorporates depending elements which are inserted into the legs and are expanded laterally to grip the legs from the inside. A further type of pants hanger provides for folding the pants around a horizontal rod and securing the legs with a second adjacent horizontal rod or wire.

In the design of any pants hanger of the above types, it is highly desirable for the hanger to be constructed so that it may be quickly and conveniently attached to the legs of the pants and may also be quickly and conveniently removed from the pants. It is also desirable for the pants hanger to provide means for conveniently releasing the pants without requiring that the hanger be removed from a supporting clothes rod of a closet or rack. Of course, it is also desirable for the pants hanger to be designed so that it may be economically manufactured with a minimum of hand labor.

SUMMARY OF THE INVENTION

The present invention is directed to an improved pants hanger which provides all of the desirable features mentioned above, and particularly, is adapted to be quickly and easily attached to pants or the like so that the pants may be suspended from a horizontal clothes rod. The pants hanger of the invention also provides for conveniently removing the supported pants from the hanger without requiring that the hanger be removed from the supporting clothes rod. As other important features, the hanger is simple to manufacture and occupies a minimum of space within a closet so that a number of pants may be supported within a short axial space along a clothes rod.

In accordance with the illustrated embodiment of the invention, a pants hanger is formed by bending a one piece metal rod to form a first lower horizontal rod portion which integrally connects a second upper horizontal rod portion to a third rod portion having a hook for engaging a clothes rod. The second rod portion is cantileveredly supported above the first rod portion by the first rod portion which, in turn, is cantileveredly supported by the third rod portion. The second rod portion has a free end which extends past the bent integral connection of the first and third rod portions and preferably projects laterally at a small angle from a reference plane defined by the three rod portions.

In accordance with the invention, the hanger is attached to a pair of pants by first inverting both the pants and the hanger and then sliding the hanger onto the pants with the second rod portion being guided onto one side of the pants and the first and third rod portions being guided onto the other side of the pants. The hanger is then rotated to an upright position so that the pants wrap around the second rod portion and are snubbed or retained by the lower first rod portion. When it is desired to remove the pants from the hanger, the pants are simply pulled forwardly or horizontally from the second rod portion. Other features and advantages of the invention will be apparent from the following description, the accompanying drawing and the appended claims.

DESCRIPTION OF THE PREFERRED EMBODIMENT

Figure 4:
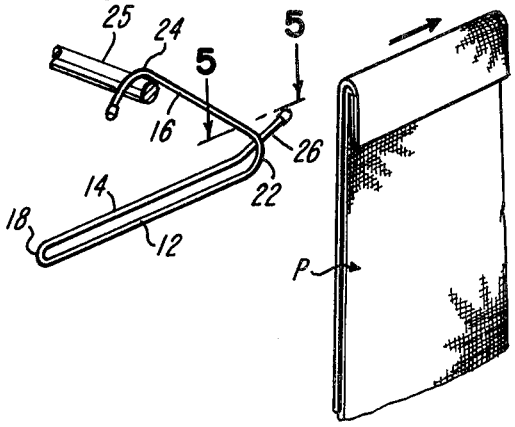
FIG. 4 is another perspective view of the hanger and illustrating how the pants may be removed.

Referring to FIG. 4, a pants hanger 10 constructed in accordance with the invention is formed by bending an elongated metal cylindrical rod which is preferably a section of an aluminum extrusion having a diameter of approximately 0.25 inch. The rod is bent to form a first elongated support member or rod portion 12, a second elongated support member or rod portion 14 and a third elongated support member or inclined rod portion 16. The rod portions 12 and 14 are generally horizontal and parallel, and the rod portion 14 is spaced directly above the rod portion 12. The rod portions 12 and 14 are integrally connected by a U-shaped bent or curved rod portion 18 forming one end of the hanger 10, and the rod portions 12 and 16 are integrally connected by a bent or curved rod portion 22.

Figure 5:
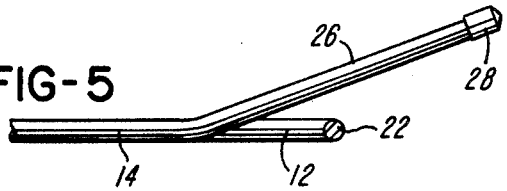
FIG. 5 is a somewhat enlarged section taken generally along the line 5—5 of FIG. 4.
Figure 6:
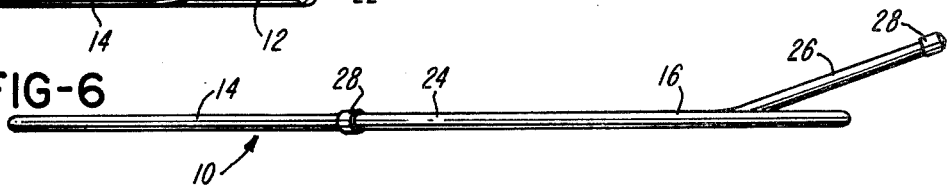
FIG. 6 is a top view of the pants hanger shown in FIGS. 1–4.

The upper end of the inclined rod portion 16 is bent or curved to form a hook 24 which is adapted to engage a horizontal clothes rod 25. Thus the rod portion 14 is cantileveredly supported by the rod portion 12 through the bent or curved portion 18, and both the rod portions 12 and 14 are cantileveredly supported by the rod portion 16 through the bent or curved portion 22. As best shown in FIG. 5, the rod portion 14 has a free tip or end portion 26 which projects laterally at an acute angle relatively to a reference plane defined by the rod portions 12, 14 and 16, and also extends forwardly past the curved portion 22 of the hanger to define a gap or throat therebetween. A pair of resilient vinyl caps 28 are pressed onto opposite ends of the formed aluminum rod to protect the ends from snagging a fabric material.

Figure 1:
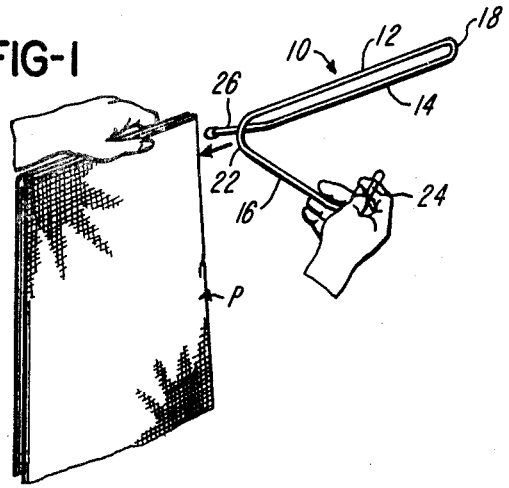
FIG. 1 is a perspective view of a hanger constructed in accordance with the invention and being held in an inverted position ready for attachment to a pair of pants.
Figure 2:
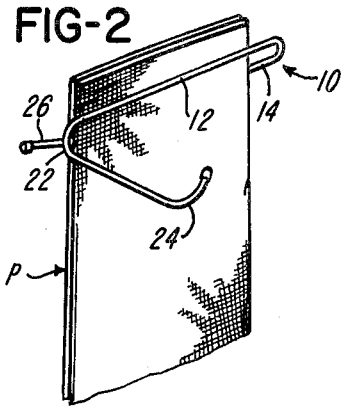
FIG. 2 shows the inverted hanger after being positioned on the pants.
Figure 3:
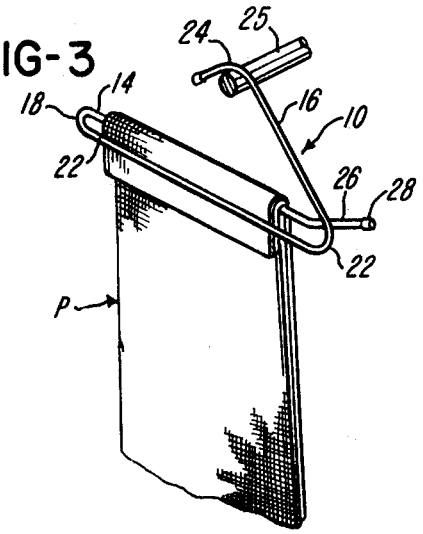
FIG. 3 shows the hanger and attached pants being supported by a clothes rod.

The hanger 10 is used in accordance with the invention by inverting the hanger, as shown in FIG. 1, while gripping the hook portion 24 in one hand. A pair of slacks or pants P are also inverted and held by the opposite hand. The hanger 10 is then shifted horizontally relative to the pants P so that the rod portion 14 is guided or directed to one side of the pants P by the forward end portion 26, and the rod portions 12 and 16 and hook 24 are guided or directed to the opposite side of the pants, as shown in FIG. 2. The hanger 10 is then rotated 180° degrees to an upright position, as shown in FIG. 3, so that the pants P wrap around the rod portion 14 and are snubbed or retained by the lower rod portion 12. In its upright position, the hanger 10 may be hooked onto the clothes rod 25 for supporting the pants in depending relation below the hook 24.

As shown in the drawing, the end portion 26 of the support rod portion 14 projects in a forward or opposite direction than the hook 24 so that the end portion 26 projects towards the front of a closet. Thus when it is desired to remove the pants P from the hanger 10, the pants are simply pulled from the hanger, and the folded end or "cuff" portions of the pants slide horizontally from the rod portion 14 and its forward end portion 26.

From the drawing and the above description, it is apparent that a hanger constructed in accordance with the present invention, provides desirable features and advantages. For example, the hanger may be quickly and conveniently mounted on a pair of pants (FIGS. 1 and 2) while the pants and hanger are supported in inverted positions by opposite hands. Thus when the hanger is rotated to an upright position (FIG. 3), the pants are automatically attached to the hanger in a manner which positively secures the pants. As mentioned above, the hanger 10 also provides for easy removal of the pants from the hanger (FIG. 4) without removing the hanger from the clothes rod 25, simply by sliding or pulling the pants forwardly off the hanger. While the hanger 10 is illustrated in the simple form of a bent one-piece metal rod and may be quickly manufactured, it is obvious that the hanger may also be molded of a rigid plastics material. In such case, it would be desirable to connect the curved end portion 18 to the rod portion 16 by another inclined rod portion to provide the hanger with sufficient strength.

While the form of hanger and method herein described constitute a preferred embodiment of the invention, it is to be understood that the invention is not limited to the precise form and method described, and that changes may be made therein without departing from the scope and spirit of the invention as defined in the appended claims.

The invention having thus been described, the following is claimed:

1. A method of producing a hanger for supporting pants from a clothes rod, comprising the steps of forming a generally horizontal elongated first support member, forming a generally horizontal elongated second support member integrally connected to the first support member and disposed thereabove in generally parallel spaced relation, forming a third support member integrally connected to the first support member and projecting above the second support member, providing the third support member with means for releasably connecting the third support member to a clothes rod with the first and second support members depending from the third support member, supporting the second support member in a cantilever manner between the first and third support members and with a free end portion, positioning the free end portion for guiding the free end portion and the second support member on one side of inverted vertical pants and the first and third support members on the other side of the pants when said hanger is inverted and slid laterally onto the pants, and maintaining the vertical spacing between the first and second support members sufficiently to avoid clamping the pants therebetween when the inverted hanger is slid laterally onto the pants to facilitate convenient and quick attachment of the hanger to the pants.

2. A method as defined in claim 1 including the step of projecting the free end portion generally horizontally past an integral connection of the first and third support members.

3. A method as defined in claim 1 including the step of spacing the free end portion of the second support member laterally from an integral connection of the first and third support members to define a horizontal gap therebetween.

4. A method of producing a hanger for supporting pants from a clothes rod, comprising the steps of forming a generally horizontal elongated first support member, forming a generally horizontal elongated a second support member integrally connected to the first support member and disposed thereabove in generally parallel spaced relation, forming a third support member integrally connected to the first support member and projecting above the second support member, providing the third support member with means for releasably connecting the third support member to a clothes rod with the first and second support members depending from the third support member, supporting the second support member in a cantilever manner between the first and third support members and with a free end portion, projecting the free end portion laterally at an acute angle from a reference plane defined by the first and second support members for guiding the free end portion and the second support member on one side of inverted vertical pants and the first and third support members on the other side of the pants when said hanger is inverted and slid laterally onto the pants, and maintaining the vertical spacing between the first and second support members sufficiently to avoid clamping the pants therebetween when the inverted hanger is slid laterally onto the pants to facilitate convenient and quick attachment of the hanger to the pants.

5. A method of producing a hanger for supporting pants from a clothes rod, comprising the steps of bending a one-piece bent metal rod to form a generally horizontal elongated first rod member and a generally horizontal elongated second rod member disposed above the first rod member in generally parallel spaced relation, bending the rod to form a third rod member projecting above the second rod member, providing the third rod member with a free end portion adapted to be releasably connected to the clothes rod, supporting the second rod member in a cantilever manner by the first rod member and supporting the first and second rod members in a cantilever manner by the third rod member, providing the second rod member with a second free end portion projecting forwardly adjacent a bent portion integrally connecting the first and third rod members, positioning the second free end portion for guiding the second rod member on one side of inverted vertical pants and the first and third rod members on the other side of the pants when said hanger is inverted and slid laterally onto the pants, and maintaining the vertical spacing between the first and second rod members sufficiently to avoid clamping the pants therebetween when the inverted hanger is slid laterally onto the pants to facilitate convenient and quick attachment of the hanger to the pants.

6. A method as defined in claim 5 including the step of directing the second free end portion of the second rod member laterally at an acute angle relative to a plane defined by the first and second rod members.

* * * * *